US008326209B2

(12) United States Patent
Fan et al.

(10) Patent No.: US 8,326,209 B2
(45) Date of Patent: Dec. 4, 2012

(54) PRINTER WITH BRACKET FOR HOLDING PAPER TRAY

(75) Inventors: Chen-Lu Fan, Taipei Hsien (TW); Chih-Kun Shih, Santa Clara, CA (US); Chun-Hsien Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 378 days.

(21) Appl. No.: 12/732,846

(22) Filed: Mar. 26, 2010

(65) Prior Publication Data

US 2011/0129272 A1 Jun. 2, 2011

(30) Foreign Application Priority Data

Dec. 1, 2009 (CN) ..... 2009 1 0310750

(51) Int. Cl.
*B41J 11/58* (2006.01)

(52) U.S. Cl. ..... 399/405; 399/410; 270/58.28

(58) Field of Classification Search ..... 399/405, 399/397, 403, 410; 400/691, 625; 271/292, 271/293, 298, 213; 270/58.18, 58.13; *B41J 11/58*
See application file for complete search history.

(56) References Cited

U.S. PATENT DOCUMENTS 3,879,032 A * 4/1975 Shirahase ..... 271/293
4,671,505 A * 6/1987 Hidaka ..... 271/293

* cited by examiner

*Primary Examiner* — Judy Nguyen
*Assistant Examiner* — Jennifer Simmons
(74) *Attorney, Agent, or Firm* — Altis Law Group, Inc.

(57) ABSTRACT

A printer includes a main body for printing and outputting paper, a bracket attached to the main body, a driving mechanism, and a tray for receiving the paper. The bracket includes two sidewalls. A retaining member is secured to each sidewall. A first spring member is secured between each retaining member and the corresponding sidewall. The driving mechanisms are secured to the sidewalls. Each driving mechanism includes a sliding member slidable on the sidewall. The tray is received in the bracket. The tray has tray posts. The sliding members are slid to bring the tray. The tray posts slide the retaining members from a first position to a second position before passing across the retaining members, and the retaining members are slid from the second position to the first position by rebounding of the first springs after the tray posts pass across the retaining members.

17 Claims, 20 Drawing Sheets

PRINTER WITH BRACKET FOR HOLDING PAPER TRAY

CROSS-REFERENCE TO RELATED APPLICATIONS

This application is related to copending application entitled, "PRINTER WITH BRACKET FOR HOLDING PAPER TRAY", filed on Apr. 6, 2010 (application Ser. No. 12/755061).

BACKGROUND

1. Technical Field

The present disclosure relates to a printer with a bracket for holding paper trays.

2. Description of Related Art

In many office settings, many different files are printed and output to a single tray before anyone comes along to pick up their print job. A person may have to sort through many printed pages searching for their print job.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
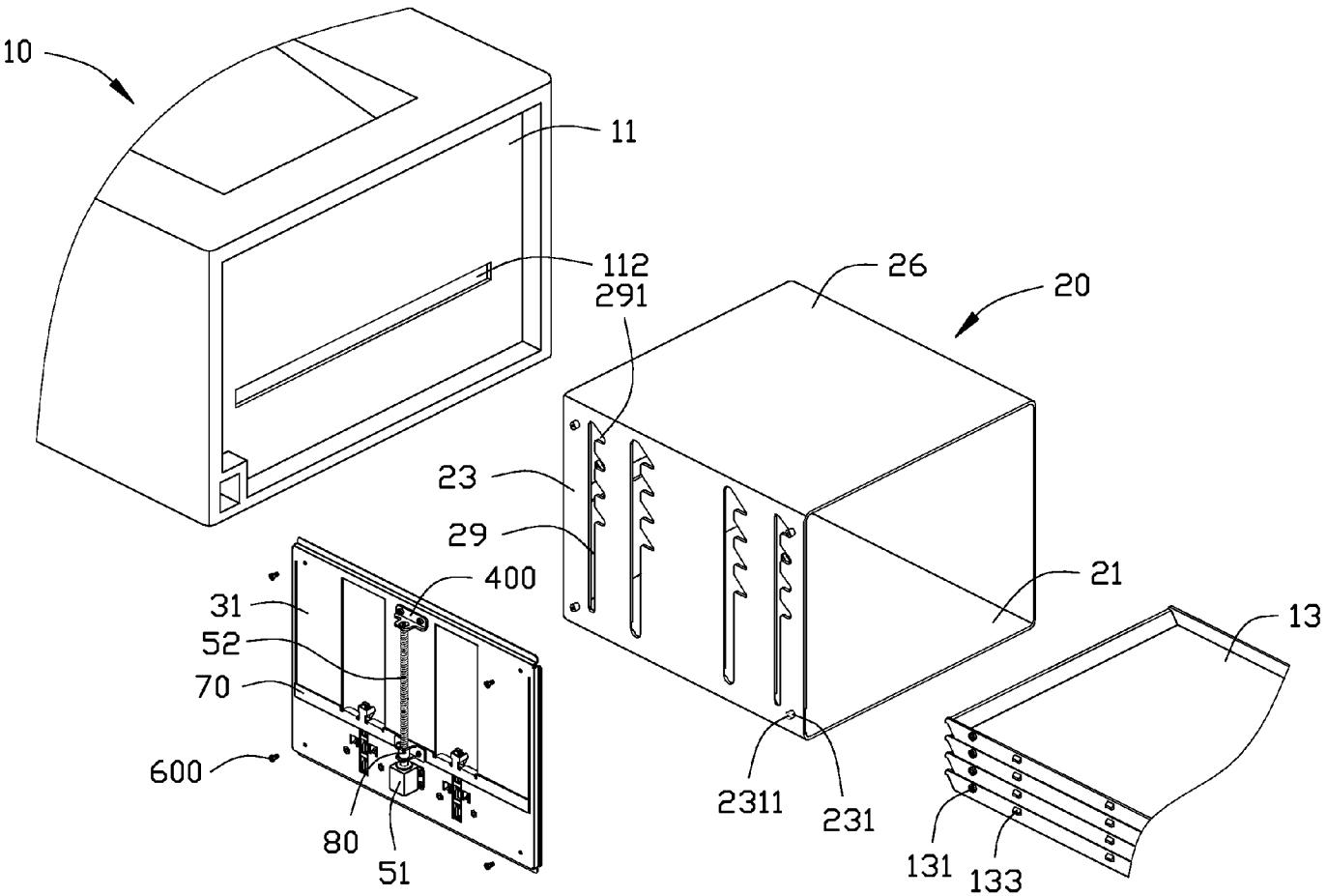
FIG. 1 is an exploded view of a printer in accordance with an exemplary embodiment.
Figure 2:
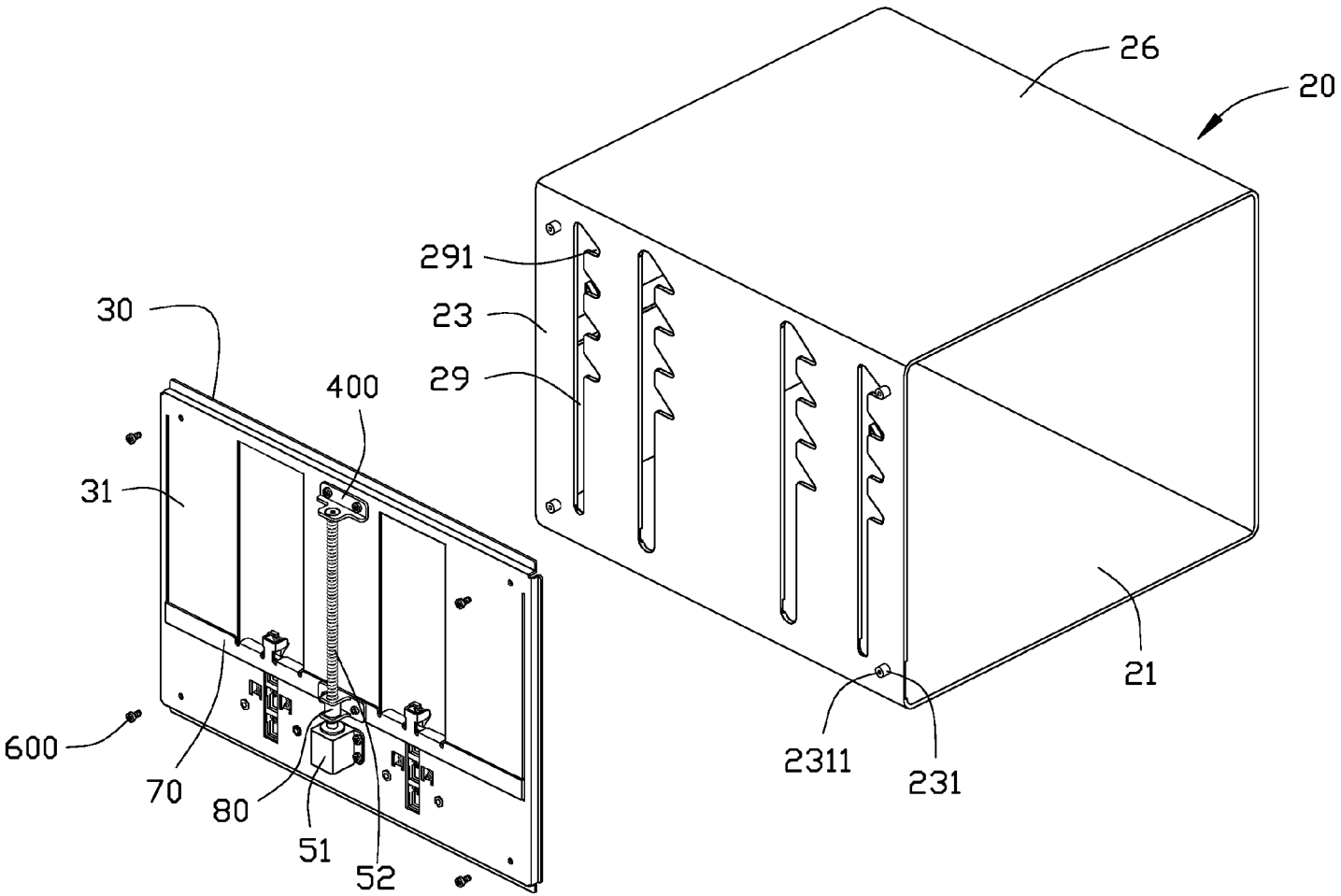
FIG. 2 is similar to FIG. 1, but only showing a driving mechanism and a bracket.

Referring to FIGS. 1-2, a printer in accordance with an exemplary embodiment includes a main body 10, a bracket 20, two driving mechanisms 50 (only one shown in the figures), and a plurality of trays 13.

The main body 10 includes a rear wall 11 and is capable of printing and outputting paper. The rear wall 11 defines an output opening 112 for outputting the paper.

The bracket 20 may include a bottom wall 21, a top wall 26, and two sidewalls 23 connected to the bottom wall 21 and the top wall 26. In an exemplary embodiment, the sidewalls 23 are substantially parallel to each other and perpendicular to the bottom wall 21 and the top wall 26, and the top wall 26 is substantially parallel to the bottom wall 21.

Figure 11:
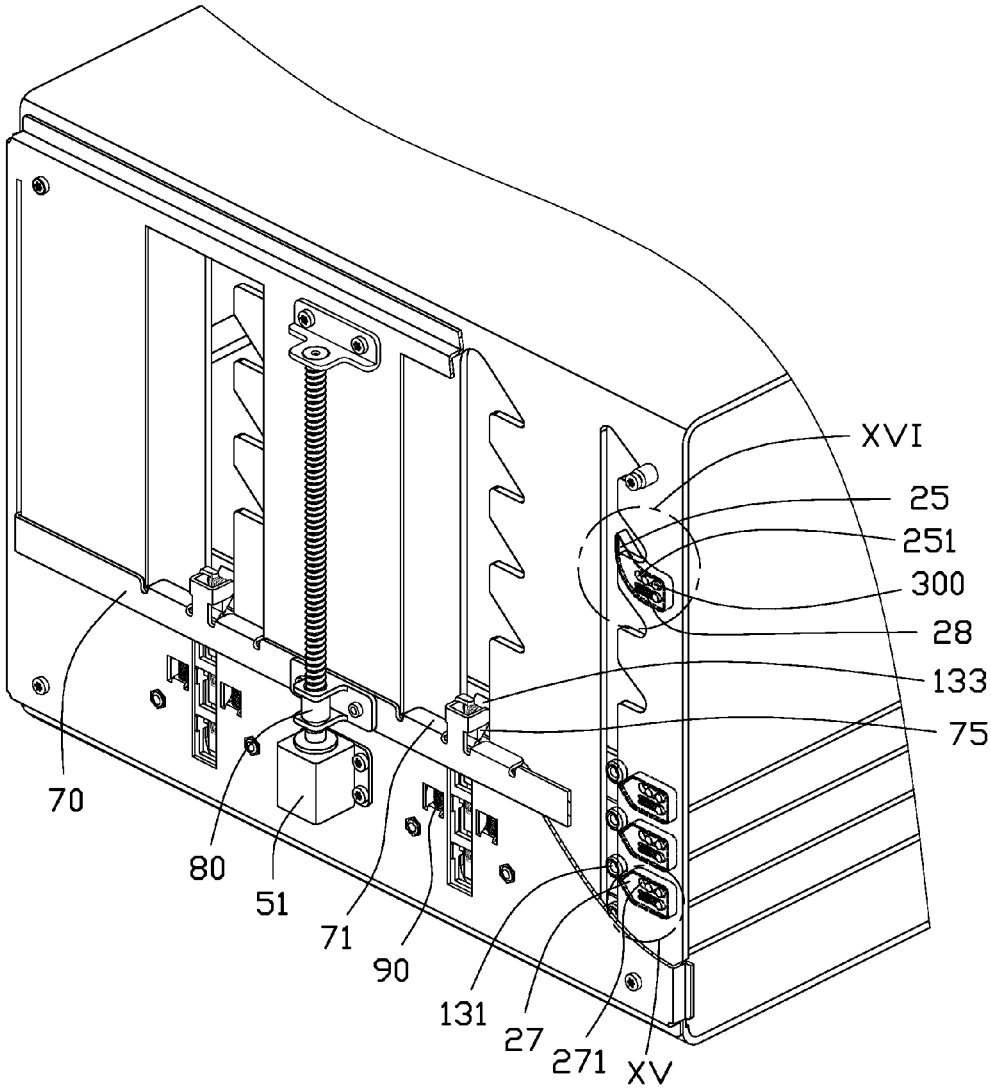
FIG. 11 is a partial, assembled, cutaway view of the driving mechanism and the bracket of FIG. 1.

Referring to FIG. 2, each sidewall 23 defines four sidewall slots 29 (only shown on one sidewall 23 in the figures) extending a first direction substantially perpendicular to the bottom wall 21. A plurality of cutouts 291 is defined in one side of each sidewall slot 29 and communicates with the corresponding sidewall slot 29. A plurality of sidewall posts 231, each with a fastener hole 2311, is located on the sidewall 23. Referring to FIG. 11, a plurality of first retaining members 25 (only one is shown in the figures) and second retaining members 27 are disposed on an inner surface of the sidewall 23 adjacent to each sidewall slot 29. The first retaining members 25 are disposed adjacent the cutouts 291.

Figure 3:
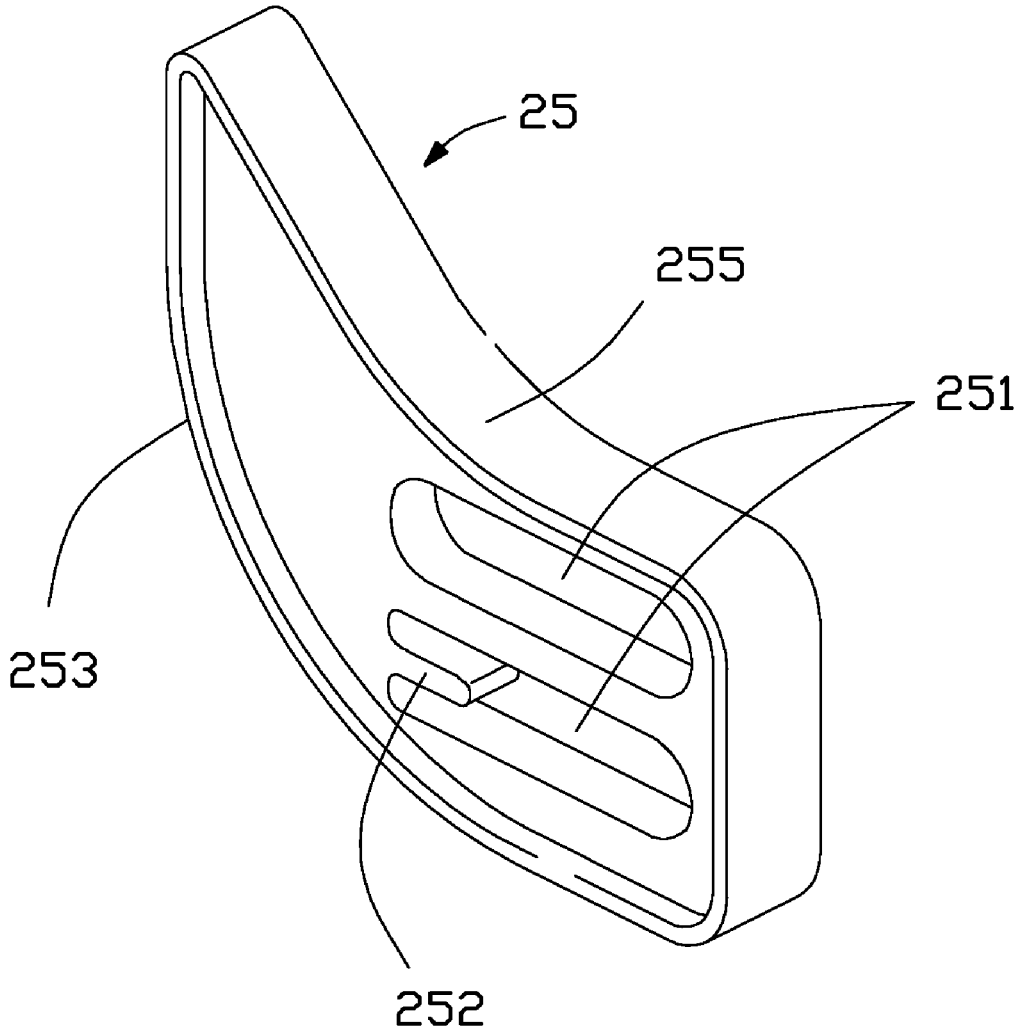
FIG. 3 is an isometric view of a first retaining member of an embodiment.

Referring to FIG. 3, each first retaining member 25 has a portion located above a bottom end of each cutout 291. An inducting surface 253 is disposed on a bottom edge of each first retaining member 25, and a retaining surface 255 is disposed on a top edge thereof. In the exemplary embodiment, the inducting surface 253 and the retaining surface 255 are arcuate. Each first retaining member 25 defines two first retaining member slots 251. Referring to FIG. 11, a plurality of first fasteners 300 is inserted through the first retaining member slots 251 and mounted to the sidewall 23, to secure the first retaining members 25 to the sidewall 23. A first retaining tab 252 extends in one of the retaining member slots 251. One end of a first spring 28 is disposed on the first retaining tab 252, and the other end thereof abuts the first fastener 300. So, the first retaining member 25 can slide on the sidewall 23 from a first position, where the first spring 28 is resiliently deformed to a first length, and a second position, where the first spring 28 is resiliently deformed to a second length less than the first length. The first springs 28 are capable of sliding the first retaining members 25 from the second position to the first position when they rebound.

Figure 4:
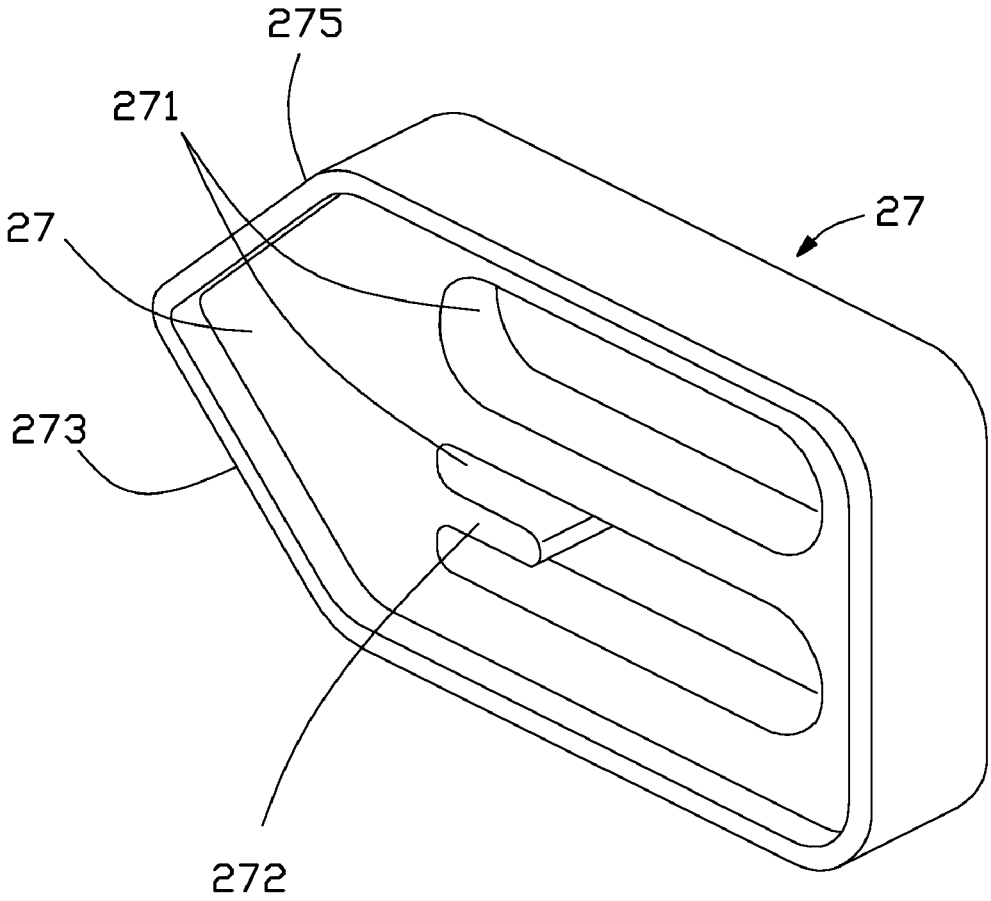
FIG. 4 is an isometric view of a second retaining member of an embodiment.
Figure 5:
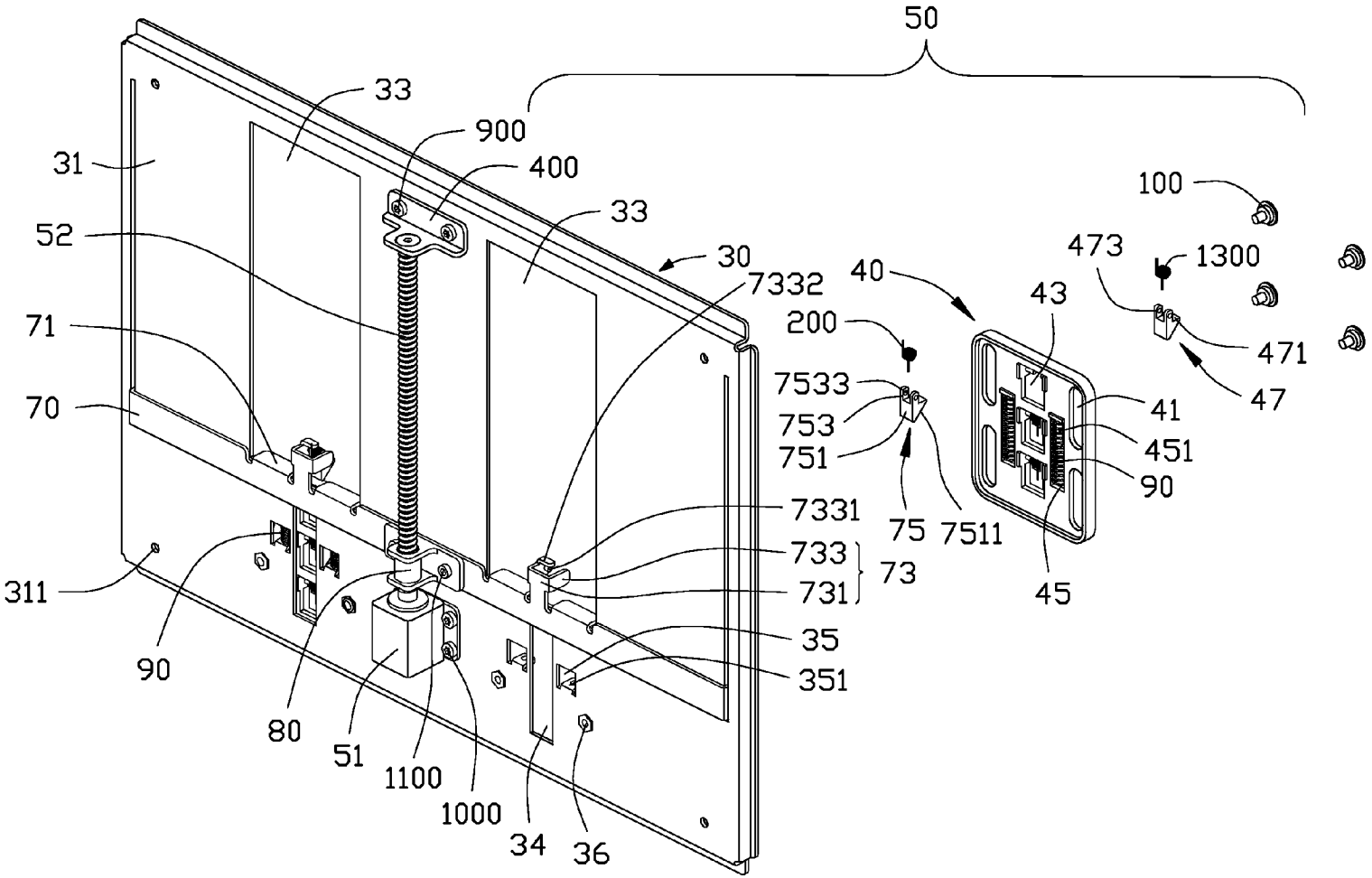
FIG. 5 is a partially exploded view of the driving mechanism of FIG. 2.
Figure 12:
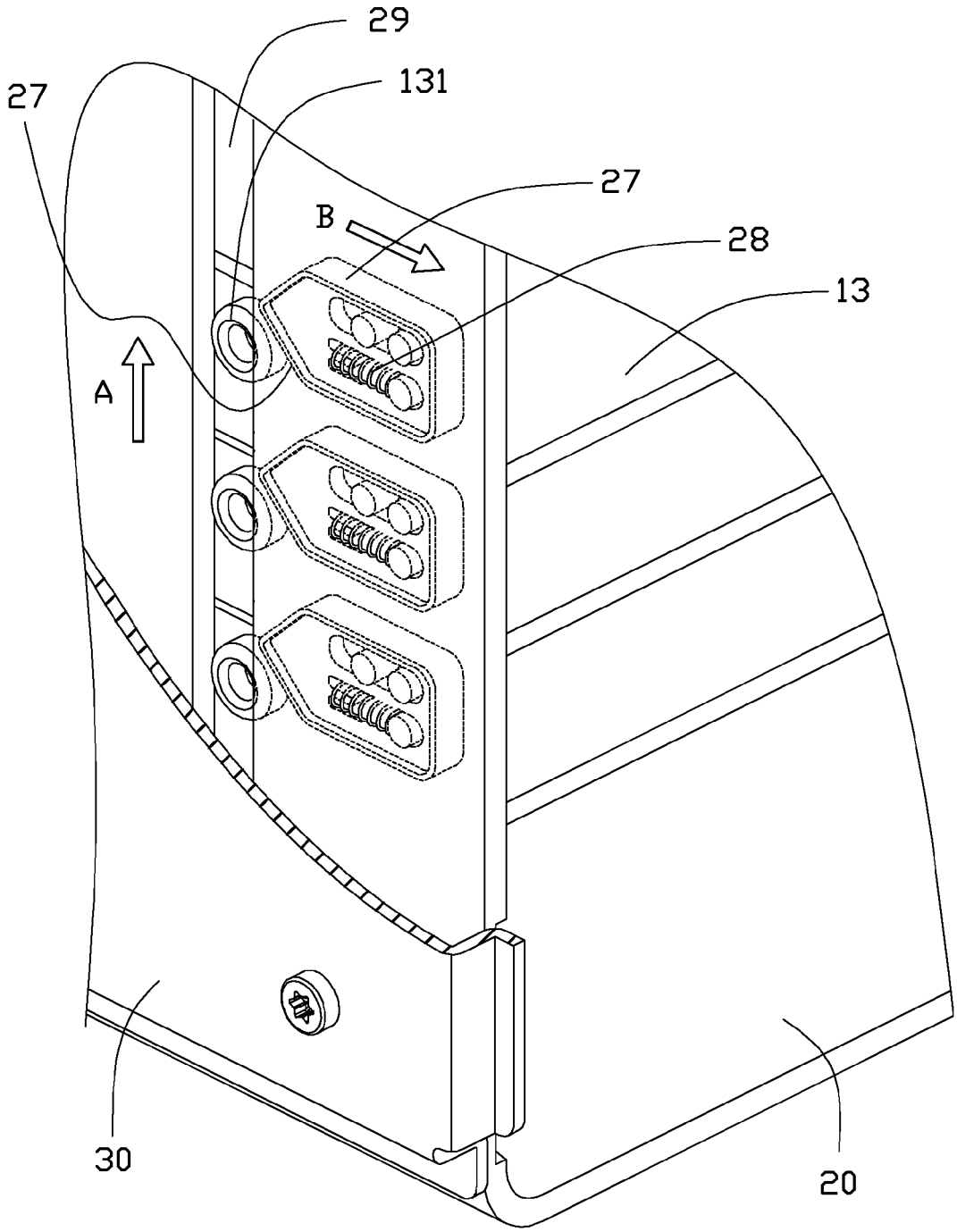
FIG. 12 is a partial, cutaway view of FIG. 11, showing the tray and the second retaining members in another position.
Figure 13:
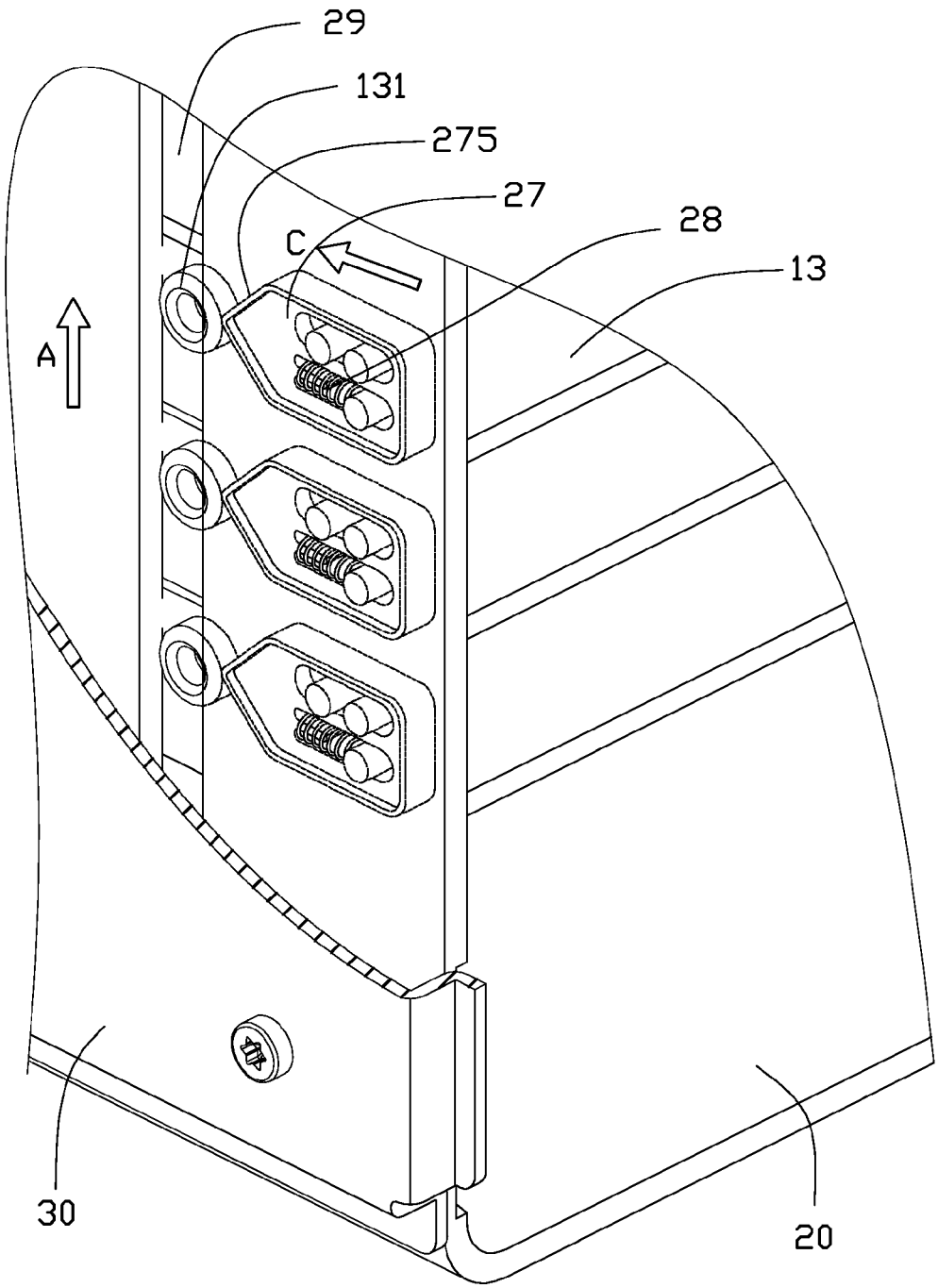
FIG. 13 is similar to FIG. 12, but showing the tray and the second retaining members in another position.
Figure 14:
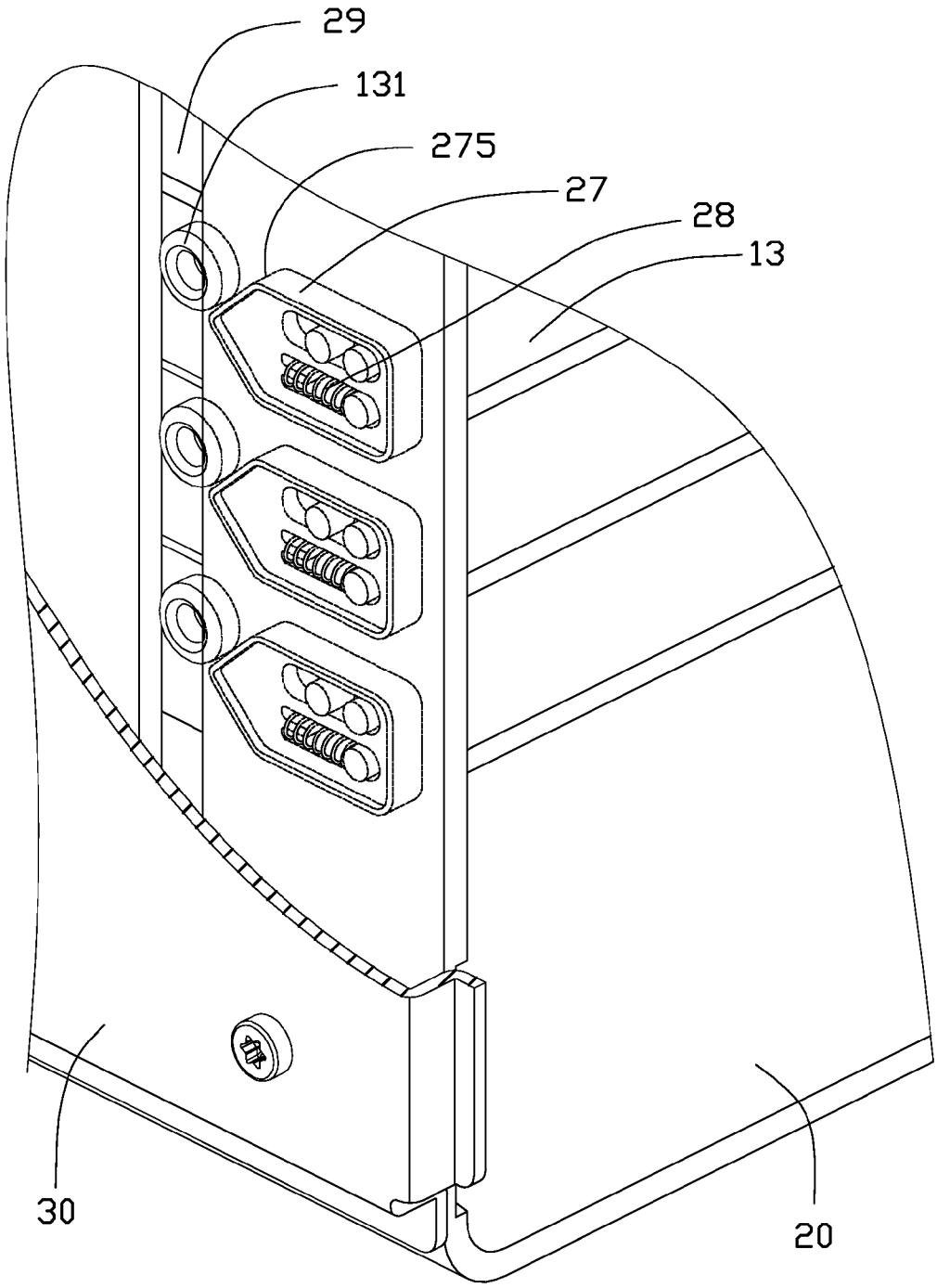
FIG. 14 is similar to FIG. 13, but showing the tray and the second retaining members in another position.
Figure 15:
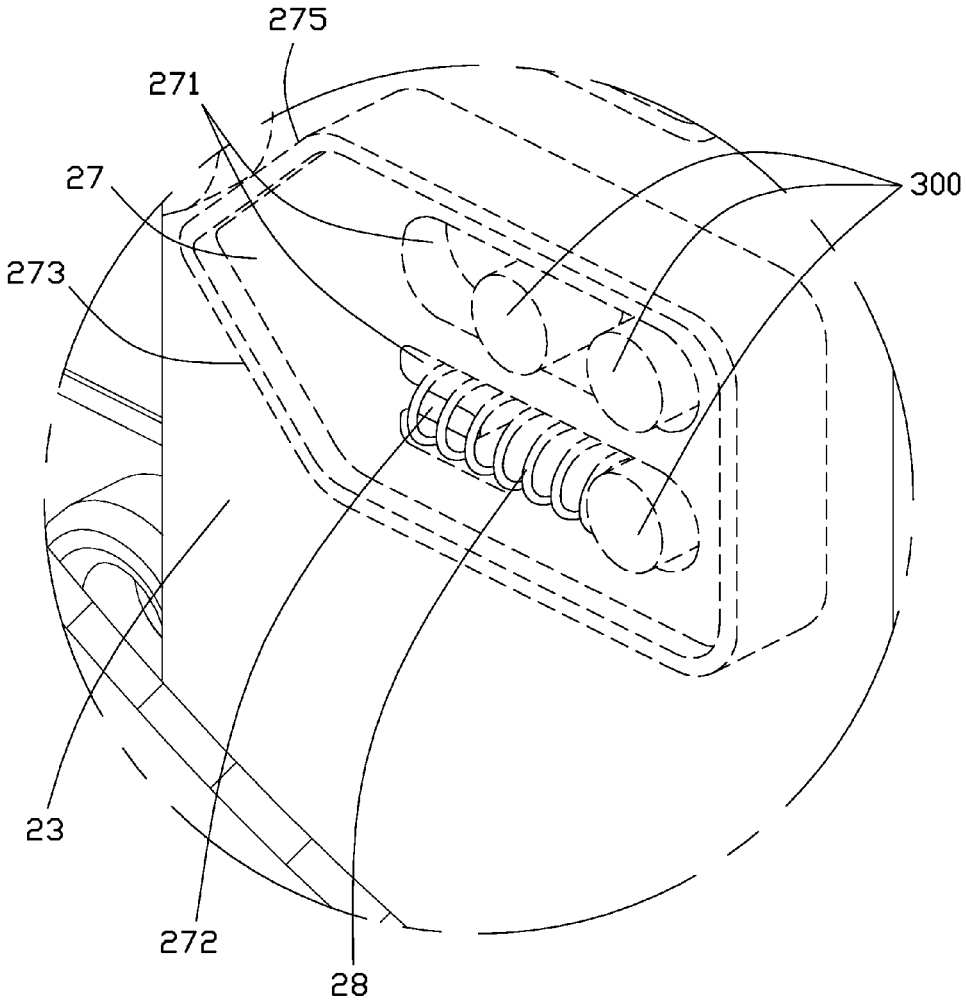
FIG. 15 is an enlarged view of XV portion of FIG. 11.
Figure 16:
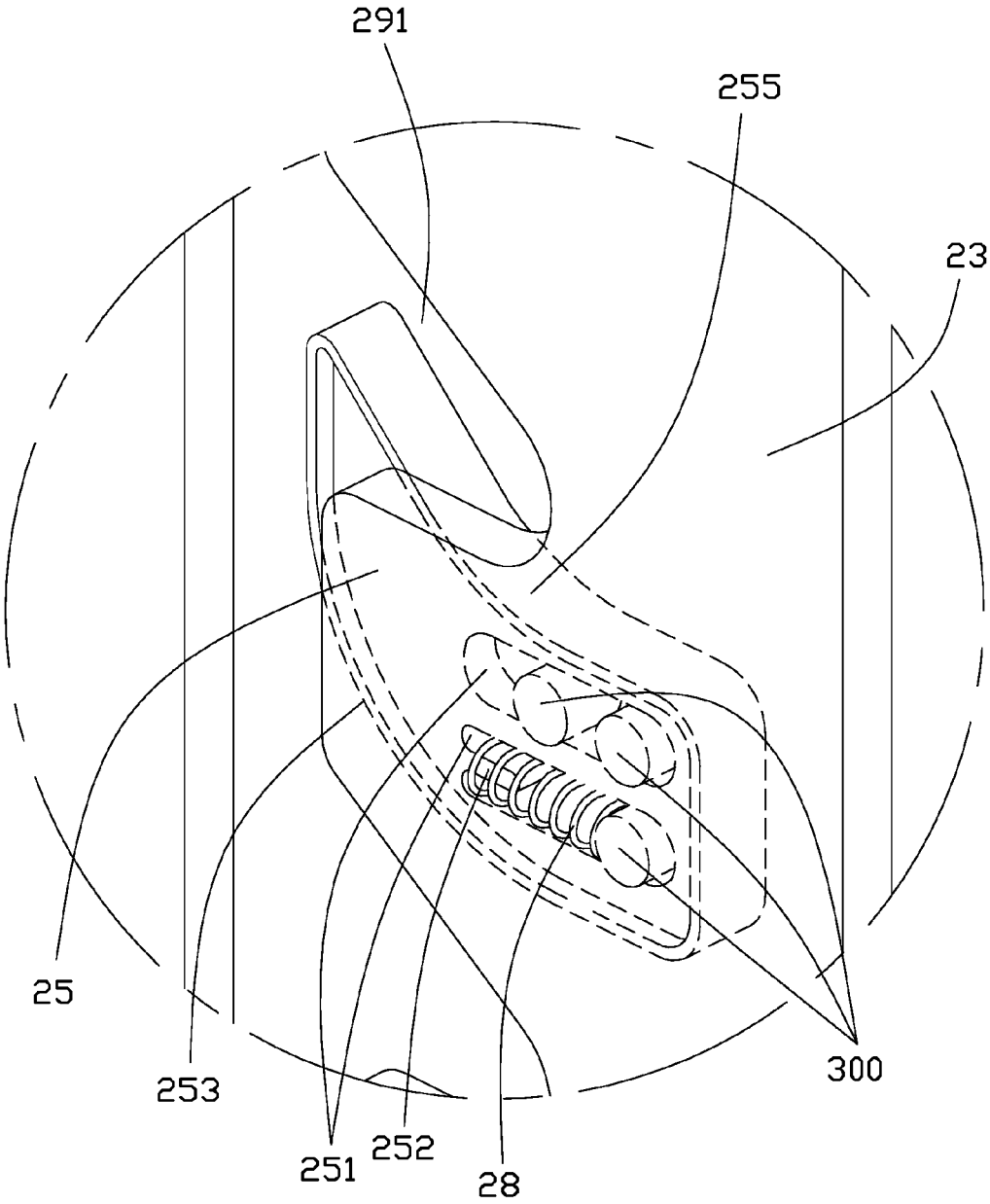
FIG. 16 is an enlarged view of XVI portion of FIG. 11.

Referring to FIG. 4, each second retaining member 27 has a guiding surface 273 and a positioning surface 275 on one end adjacent the sidewall slot 29. In an exemplary embodiment, the guiding surface 273 and the positioning surfaces 275 are aslant. Each second retaining member 27 defines two second retaining member slots 271. Referring also to FIG. 12, in an exemplary embodiment, each second retaining member 27 is slidably secured to the sidewall 23 by a same means as the first retaining member 25, by the first fasteners 300. Also, a second retaining tab 272 is located in one of the second retaining member slots 271. Another first spring 28 is disposed on the second retaining tab 272 and abuts one first fastener 300 in the corresponding second retaining slot 271.

Referring FIGS. 2-6, each driving mechanism 50 includes a supporting plate 30, a sliding member 70, a motor 51, a shaft 52, and two sliding blocks 40.

The supporting plate 30 defines a plurality of supporting plate holes 311, which receive the sidewall posts 231. A plurality of fasteners 600 secures the supporting plate 30 to the bracket 20. Two supporting plate openings 33 are defined in the supporting plate 30. A securing member 400 is secured to an outer surface of the supporting plate 30 between the supporting plate openings 33 by two third fasteners 900, such as screws or bolts.

The motor 51 is secured to the outer surface of the supporting plate 30 by fourth fasteners 1000, such as screws or bolts. A threaded shaft 52 is disposed on the motor 51 and the securing member 400 and rotates when driven by the motor 51.

The sliding member 70 is secured to the shaft 52 with a sleeve member 80, which defines a threaded hole to receive the shaft 52. The sleeve member 80 is secured to the sliding member 70 by fifth fasteners 1100, such as screws or bolts. The sleeve member 80 can slide on the shaft 52 when the shaft 52 is rotated, and the sliding member 70 can be slid with the sleeve member 80. Two retaining portions 73 are disposed on the sliding member 70, and two blocking pieces 71 are disposed on two sides of each retaining portion 73. Each retaining portion 73 includes an extending piece 731 and two retaining pieces 733 extending from the extending piece 731. A positioning pin 7331 and a block tab 7332 are disposed on each retaining pieces 733. The blocking pieces 71 are configured to be engaged in the supporting plate openings 33 and can be blocked by edges of the supporting plate openings 33, to limit moving distance of the sliding member 70.

Figure 6:
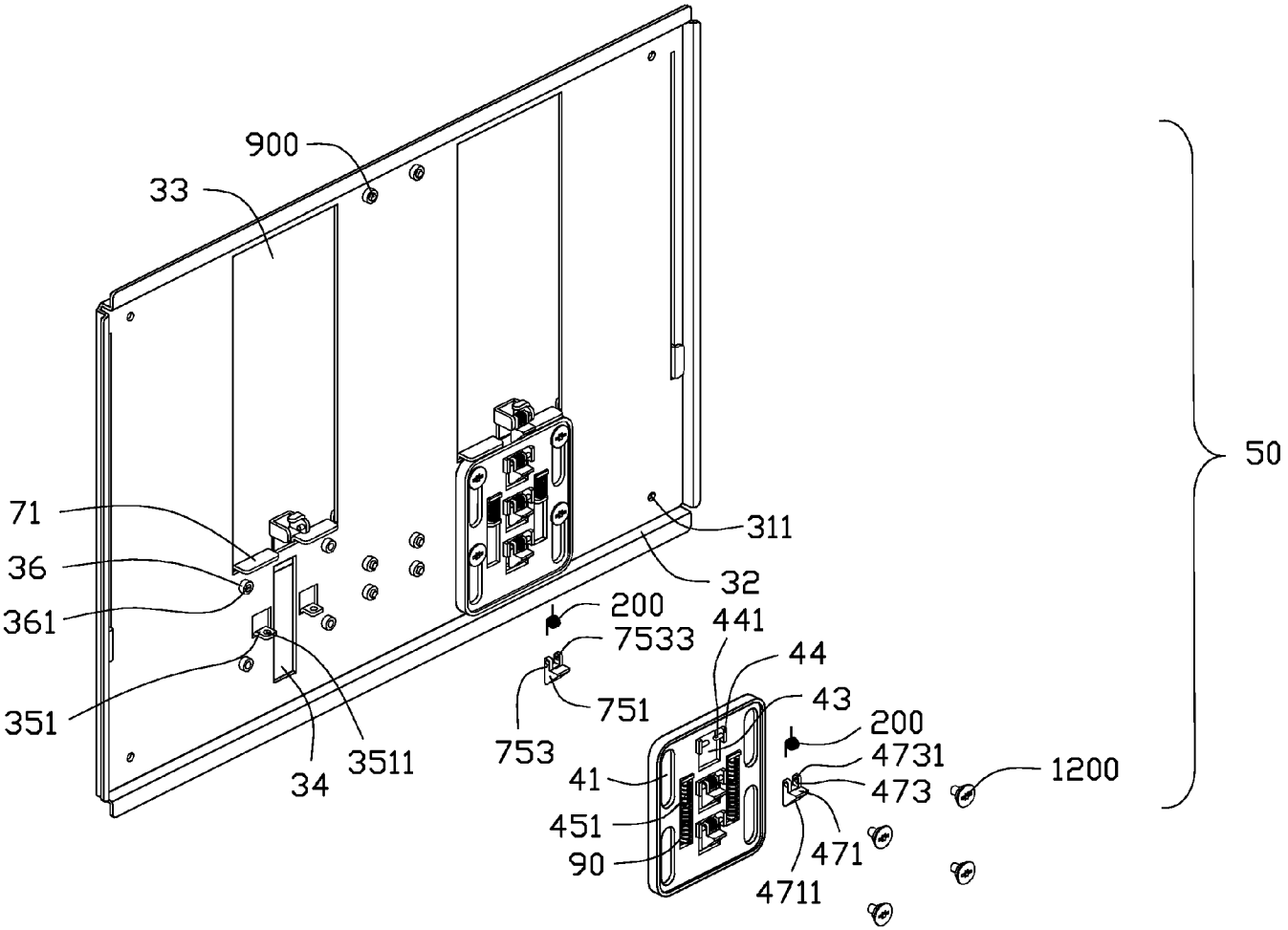
FIG. 6 is similar to FIG. 5, but shown from a different aspect.
Figure 7:
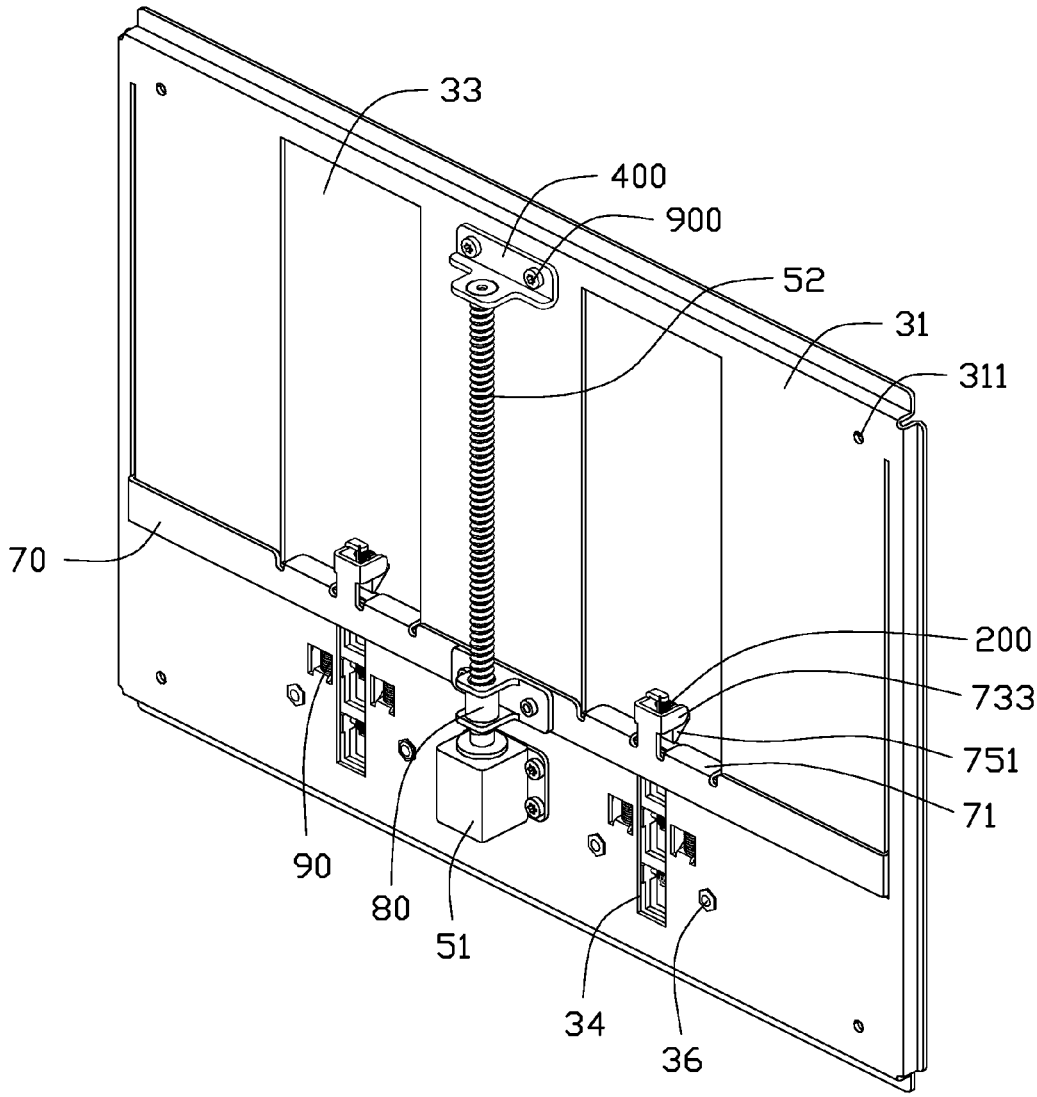
FIG. 7 is an assembled view of FIG. 5.
Figure 8:
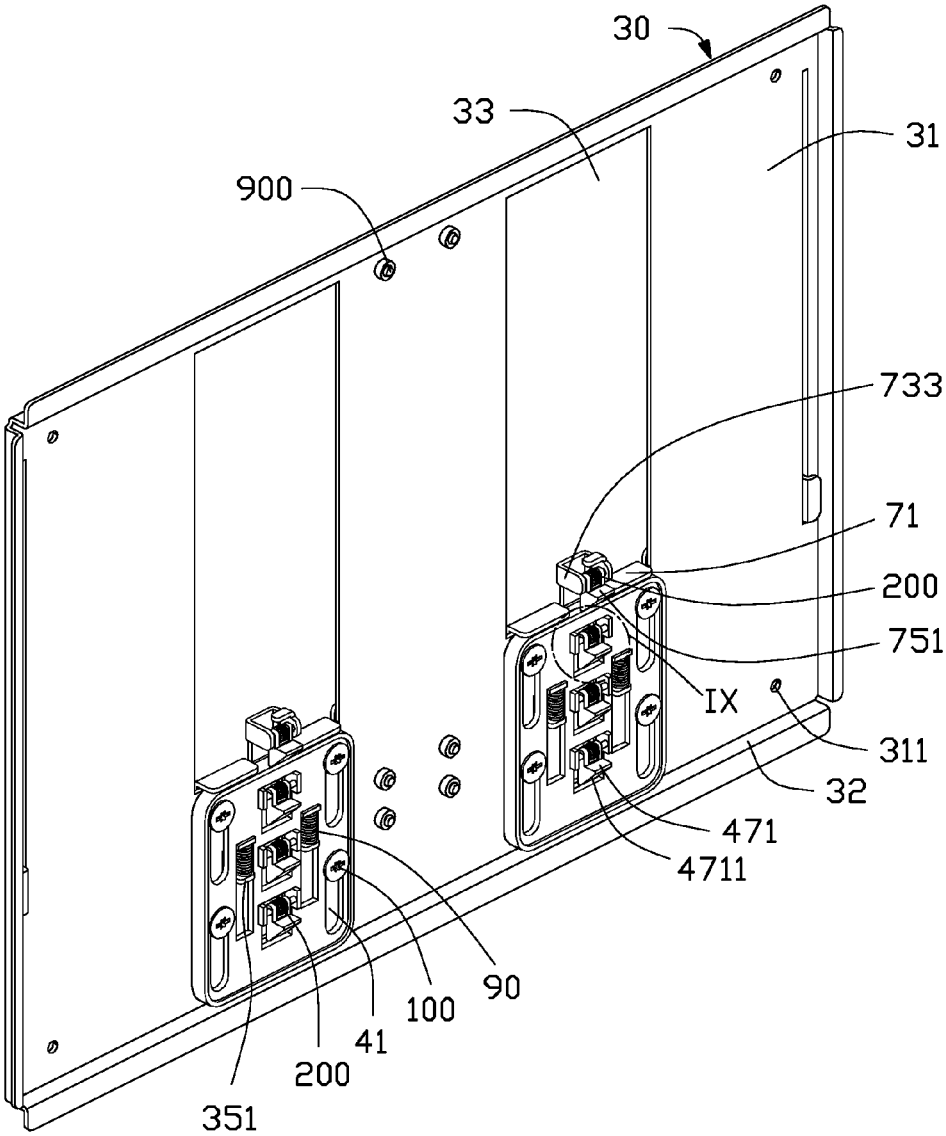
FIG. 8 is an assembled view of FIG. 6.
Figure 9:
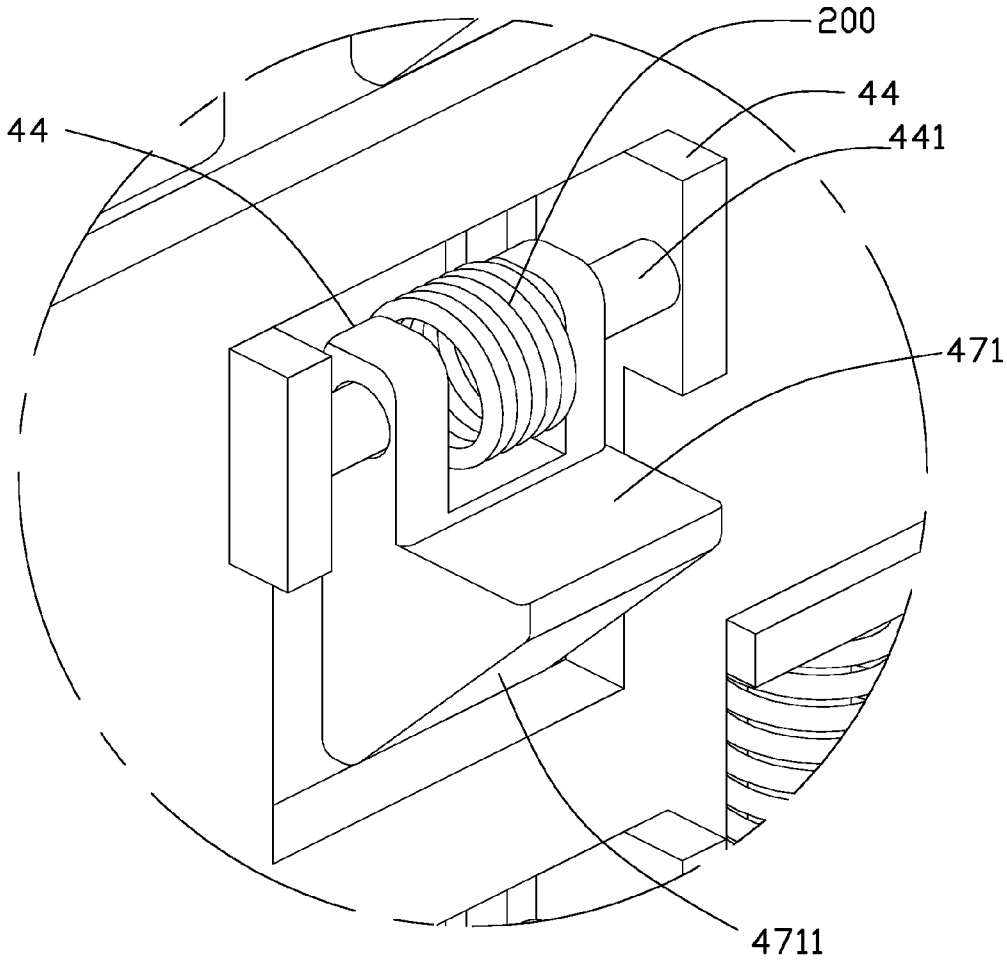
FIG. 9 is an enlarged view of IX portion of the driving mechanism of FIG. 6.

Referring to FIGS. 4, 6 and 7, a locking member 75 is secured to each retaining portion 73 and includes a locking portion 751 and two extending portions 753 extending from the locking portion 751. The locking portion 751 has a leading surface 7511. In one exemplary embodiment, the leading surface 7511 of each locking member 75 is aslant. Each extending portion 753 defines a locking member hole 7533, and each of the locking member holes 7533 receives the positioning pins 7331 of the retaining portion 73, to rotatably secure the locking member 75 to each retaining portion 73. A second spring 200 is disposed on the positioning pins 7331 of each retaining portion 73.

One end of the second spring 200 abuts the block tab 7332, and the other end thereof abuts the locking portion 751. The second spring 200 can be resiliently deformed when the locking members 75 are pressed to rotate towards to the supporting plate 30, and rebounds, when the locking members 75 are released, to rotate the locking members 75 away from the supporting plate 30.

Referring to FIGS. 3-7, a supporting plate slot 34 is defined in the supporting plate 30 below each supporting plate opening 33. Two supporting plate nuts 36 and a supporting plate piece 351 are located on each of two opposite sides of the supporting plate slot 34. Each supporting plate nut 36 defines a thread hole 361, and the supporting plate piece 351 defines a piece hole 3511. Two sliding blocks 40 are configured to be attached to the inner surface of the supporting plate 30. Each sliding block 40 defines four sliding block slots 41, which receive the supporting plate nuts 36. Four sixth fasteners 1200 are inserted through the block slots 41 and secured to the thread holes 361, to slidably secure the sliding blocks 40 to the supporting plate 30.

Two holding slots 45 are defined in each sliding block 40, and two holding posts 451 are located on each sliding block 40. Two third springs 90 are located on the holding posts 451 and abut the supporting plate pieces 351. The holding posts 451 can be inserted into the piece holes 3511. Each sliding block 40 can be slid by the blocking pieces 71 of the sliding member 70 from a first position, and a second position, where the third springs 90 has a length that is less than when in the first position. The third springs 90 can slide the sliding blocks 40 from the second position to the first position when they rebound.

Three latch members 47 are secured to each sliding block 40. Three fourth springs 1300 are secured to each sliding block 40. The fourth springs 1300 can be resiliently deformed when the latch members 47 are pressed to rotate towards the supporting plate 30, and rebound when the latch members 47 are released, to rotate away from the supporting plate 30. In an exemplary embodiment, three pairs of positioning pieces 44 each with a piece pin 441 are located on each sliding block 40, and each latch member 47 has the same structure as the locking member 75. The latch member 47 also includes a locking portion 471 and two extending portions 473. Each locking portion 471 has a leading surface 4711. Each extending portion 473 also defines a locking member hole 4731, which receives one of the piece pins 441 to rotatably secure the latch member 47 to the sliding block 40.

Referring to FIG. 1, the bracket 20 is configured to hold a plurality of trays 13 (only four are shown in FIG. 1). Each tray 13 has two tray posts 131 and two tray blocks 133, respectively corresponding to the sidewall slots 29 of the bracket 20.

Figure 10:
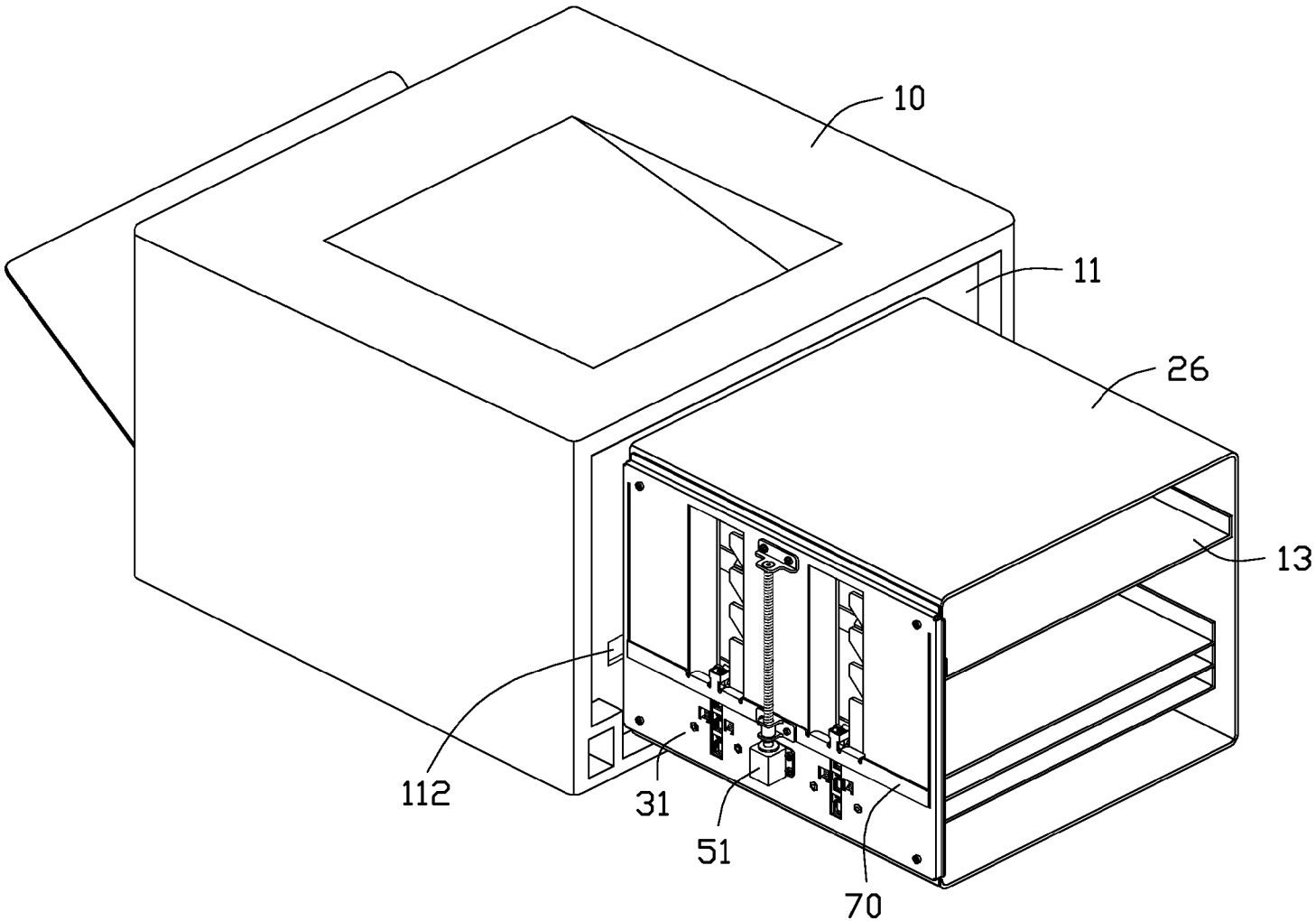
FIG. 10 is an assembled view of the printer of FIG. 1.

Referring to FIG. 10, the bracket 20 is secured to the rear wall 11 of the main body 10. The output opening 112 is adjacent the bottom wall 21 of the bracket 20.

Referring to FIGS. 10-13, in use, when one tray 13 is inserted into the bracket 20 adjacent to the bottom wall 21, the sliding blocks 40 are positioned in the first position, and the latch members 47 are positioned above the tray 13. The motor 51 rotates the shaft 52 in a first direction, to move the sliding member 70 downwardly. The sliding member 70 slides the sliding blocks 40 downwardly by the blocking pieces 71 pressing the sliding blocks 40 from the first position to the second position. During sliding the sliding blocks 40 downwardly, the latch members 47 are rotated from towards the support plate 30 when the leading surfaces 4711 of the locking portions 471 are pressed by the tray blocks 133 of the tray 13, and the fourth springs 1300 are resiliently deformed. After the locking portions 471 pass across the tray blocks 133, the latch members 47 are rotated towards the tray 13 to engage the locking portions 471 with the tray blocks 133 for rebounding of the fourth springs 1300. At this time, the motor 51 rotates the shaft 52 in a second direction reverse to the first direction, to move the sliding member 70 upwardly. The sliding blocks 40 are slid upwardly from the second position to the first position, thereby lifting the sliding blocks 40 to slide upwardly (along arrow direction A shown in FIG. 12). So, the tray 13 is lifted up.

When the tray posts 131 of the tray 13 press the guiding surfaces 273 of the second retaining members 27, the second retaining members 27 are slid in a third direction (along arrow direction B shown in FIG. 12) substantially perpendicular to the first direction, and the first springs 28 are resiliently deformed. After the tray posts 131 pass across the guiding surfaces 273, the second retaining members 27 are slid in a fourth direction (along arrow direction C shown in FIG. 13) reverse to the third direction by the rebounding of the first springs 28. The tray posts 131 are positioned on the positioning surfaces 275 of the second retaining members 27 (shown in FIG. 11). At this time, the second sliding blocks 40 are positioned in the second position.

By repeatedly sliding the sliding blocks 40 between the first position and the second position, the sliding blocks 40 can lift a plurality of trays 13 to position on the second retaining members 27 respectively. For example, three trays 13 are positioned on the second retaining members 27, and one tray 13 is inserted in below the three trays 13, as shown in FIG. 11. In an exemplary embodiment, the tray 13 positioned in a top position align with the output opening 112.

Figure 17:
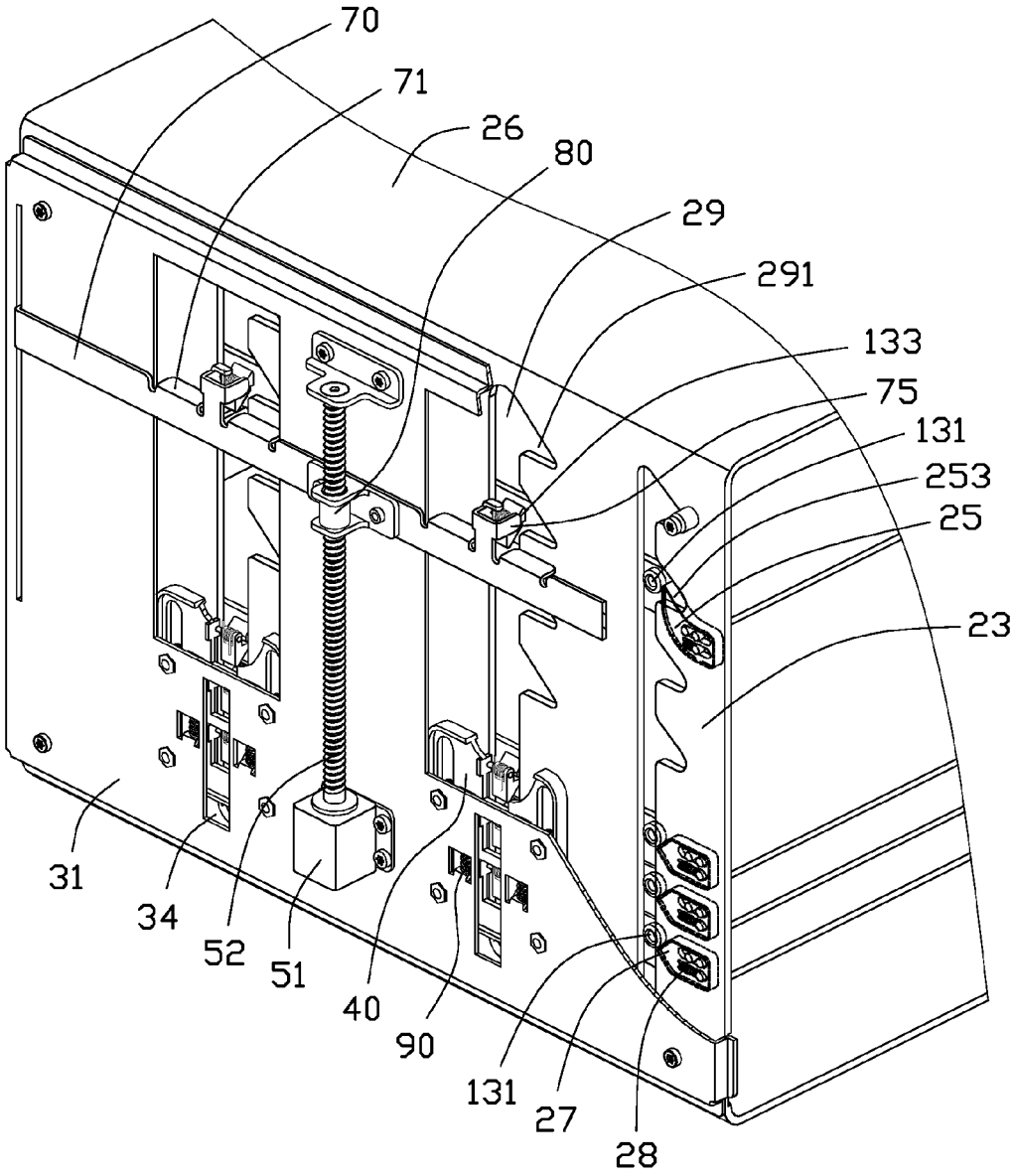
FIG. 17 is similar to FIG. 11, but showing the sliding member and one tray in a different position.

After a file is printed by the main body 10, paper is output from the output opening 112 to the tray 13 at the top position, the motor 51 rotates the shaft 52 in the first direction to slide the sliding member 70 downwardly. The sliding member 70 is slid from the first position towards the second position. When the leading surfaces 7511 of the locking members 75 are pressed by the tray posts 131, the locking members 75 are rotated from the first position to the second position, and the second springs 200 are resiliently deformed. At this time, the locking members 75 are pressed by the corresponding tray posts 131 to be rotated from the first position towards the supporting plate 30, and the fourth springs 1300 are resiliently deformed. After the leading surfaces 7511 of the locking members 75 and the leading surfaces 4711 of the latch members 47 pass across the corresponding tray posts 131, respectively. The second and fourth springs 200, 1300 rebound to respectively rotate the locking member 75 and the latch members 47 towards the trays 13, thereby engaging the locking members 75 and the latch members 47 with the corresponding tray posts 131. Then the motor 51 rotates the shaft 52 in the second direction, to slide the sliding member 70 upwardly. When the blocking pieces 71 are disengaged from the sliding blocks 40, the trays 13 engaged with the latch members 47 are located positioned on the second retaining members 27 (shown in FIG. 17), and the tray 13, which is in the top position, is still engaged with the locking members 75.

Figure 18:
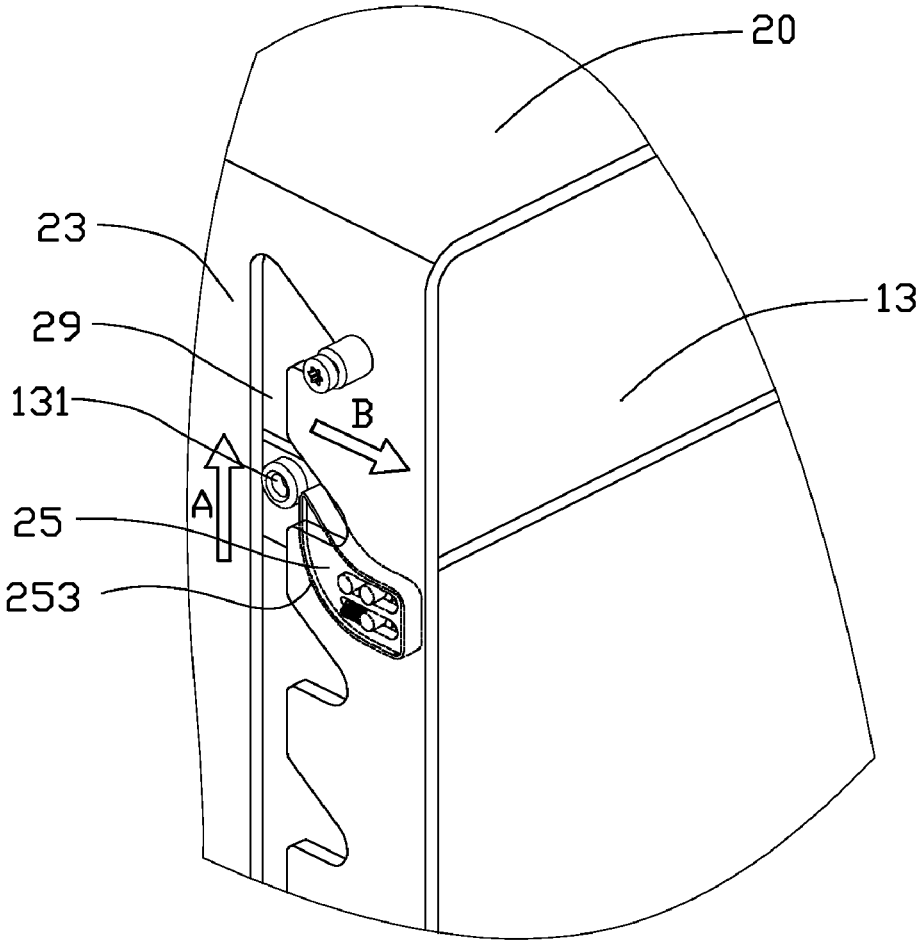
FIG. 18 is a partial, cutaway view of FIG. 17.
Figure 19:
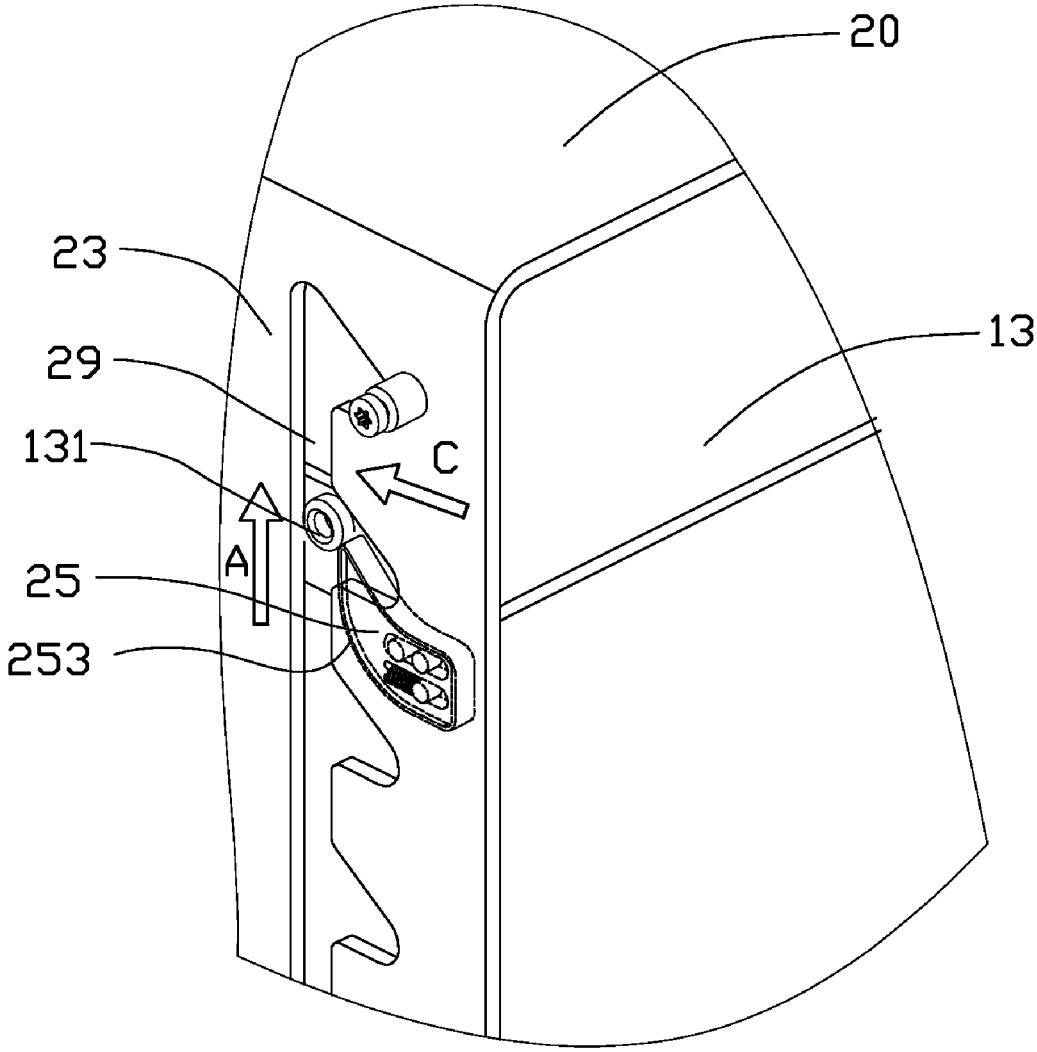
FIG. 19 is similar to FIG. 18, but showing the tray and the first retaining member in another position.

Referring to FIGS. 18-19, the motor 51 further rotates the shafts 52 in the second direction, and the locking members 75 bring up the tray 13 with the paper (along arrow direction A shown in FIG. 18). When the tray posts 131 press the inducting surfaces 253 of the first retaining members 25 to slide in the third direction (along arrow direction B shown in FIG. 18) from the first position to the second position, the first springs 28 are resiliently deformed. After the tray posts 131 pass across the inducting surfaces 253, the first retaining members 25 are slid in the fourth direction (along arrow direction C shown in FIG. 19) from the second position to the first position. When the trays posts 131 pass across the inducting surfaces 253 of the first retaining members 25, which is adjacent the top wall 26 of the bracket 20, and the corresponding first retaining members 25 are slid to the first position. At this time, the motor 51 rotates the shaft 52 in the first direction to slide the sliding member 70 downwardly. The tray posts 131 are positioned on and slid along the retaining surfaces 255 of the corresponding first retaining members 25 (shown in FIG. 20), to extend out of the bracket 20, for conveniently taking the tray 13 out of the bracket 20.

Figure 20:
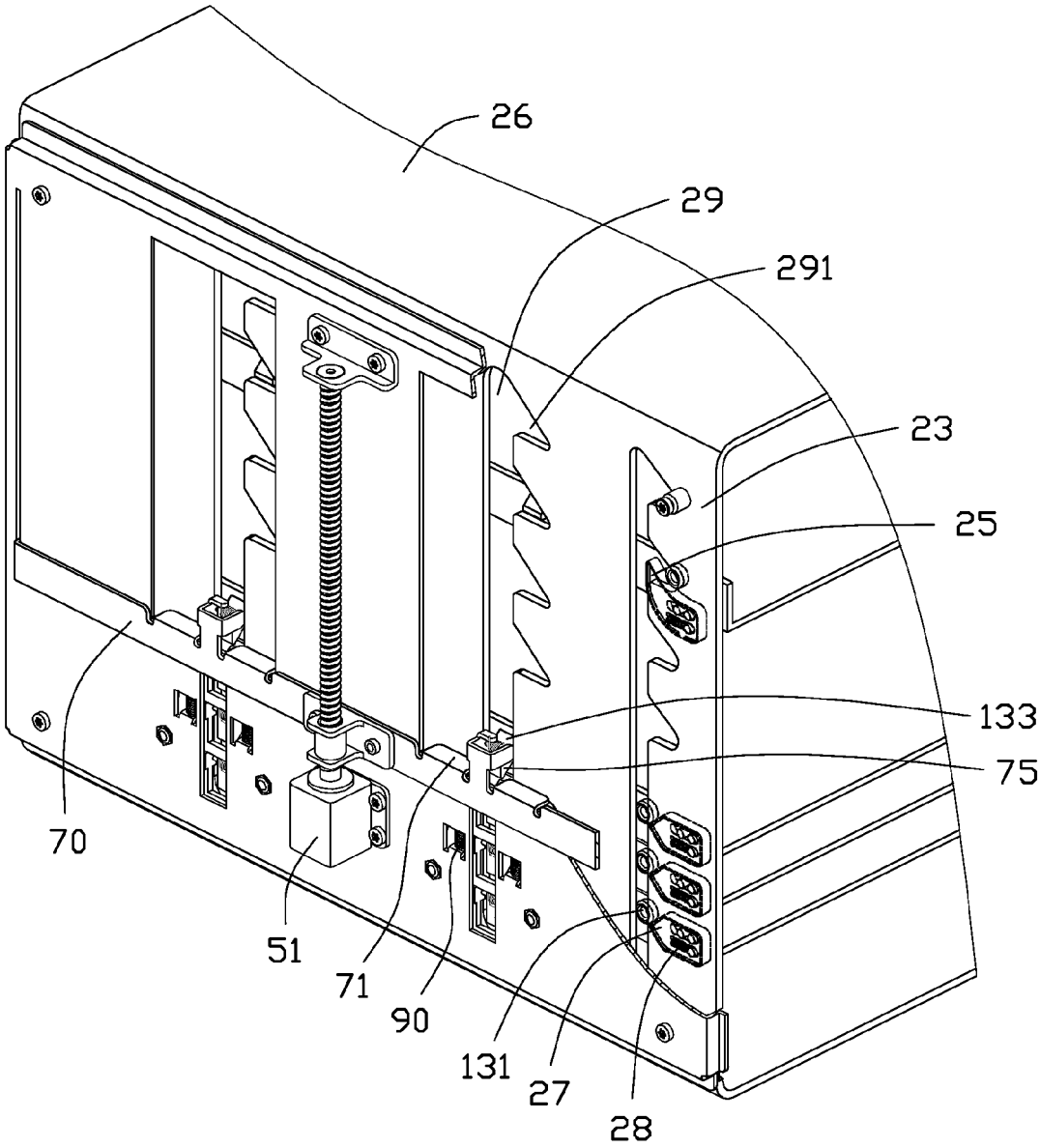
FIG. 20 is similar to FIG. 17, but showing the sliding member, and yet another position.

Referring to FIG. 20, the sliding member 70 is slid downwardly by the motor 51 when another file is printed and output to another tray 13, to lift up the another tray 13 to another first retaining members 25.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A printer, comprising:

a main body capable of printing and outputting paper;

a bracket attached to the main body and comprising two sidewalls, a retaining member secured to each sidewall, a first spring member secured between each retaining member and the corresponding sidewall, each retaining member being slidable from a first position and a second position, where the first spring member has a resilient deformation greater than that in the first position;

two driving mechanisms secured to each sidewall, each driving mechanism comprising a sliding member and a shaft, the shaft is rotatable relative to the sidewalls, and the sliding member being slidable on each sidewall of the bracket when the shaft is rotated; and a tray configured for receiving paper output from the main body and received in the bracket, the tray having tray posts corresponding to the retaining members;

wherein the sliding members are slidable to engage the tray, the tray posts are capable of moving the retaining members from the first position to the second position before passing across the retaining members, and the retaining members will slide from the second position to the first position due to the first springs, after the tray posts pass across the retaining members;

wherein a locking member is attached to each sliding member and rotatable relative to the sliding member; and wherein the locking member is rotatable about an axis, and the axis is substantially perpendicular to the shaft and a sliding direction of the sliding member.

2. The printer of claim 1, wherein a second spring member is secured to each sliding member; and the locking member has a first location and a second location, where the second spring member has a resilient deformation greater than that in the first location.

3. The printer of claim 2, wherein the tray comprises tray blocks; and the locking members are disengaged from the tray blocks when the locking members are in the first location, and engaged with the tray blocks when the locking members are in the second location.

4. The printer of claim 1, wherein each driving mechanism further comprises a motor; the shaft is rotatable by the motor; and the sliding members are slidable relative to the shaft.

5. The printer of claim 1, wherein each driving mechanism further comprises a supporting plate secured to each sidewall of the bracket; the supporting plate defines a supporting plate opening; and each sliding member comprises a blocking piece engaged in the supporting plate opening.

6. The printer of claim 5, wherein each supporting plate is positioned between the sliding member and the sidewall.

7. The printer of claim 1, wherein each retaining member comprises an inducting surface; and the tray post is slidable to move the retaining member from the first position to the second position by pressing the inducting surface.

8. The printer of claim 1, wherein each retaining member comprises a retaining surface; and the tray post is slidable along the retaining surface when the tray post is released from the sliding member.

9. A printer, comprising:

a main body capable of printing and outputting paper;

a bracket attached to the main body and comprising two sidewalls, a retaining member secured to each sidewall;

two sliding members slidably attached to the bracket;

two locking members, and each locking member attached to each sliding member; and a tray configured for receiving paper output from the main body and received in the bracket, the tray comprising tray posts corresponding to the retaining members;

wherein the sliding members are slidable relative to the two sidewalls each retaining member has a first position, where the tray posts press the retaining members to slide before passing across the retaining members, and a second position, where the tray posts are blocked by the retaining member when the tray is released from the sliding member; when the sliding members are slid, the locking members are rotatable to engage with the tray; and wherein the locking member is rotatable about an axis, and the axis is substantially perpendicular to a sliding direction of the sliding member.

10. The printer of claim 9, further comprising a plurality of fasteners and first springs, wherein each retaining member defines a slot, and each fastener is engaged with each sidewall through the slot; and each fastener is slidable in the slot.

11. The printer of claim 10, wherein each retaining member further comprises a retaining tab located in the slot, and each first spring is secured to the retaining tab and the fastener.

12. The printer of claim 11, wherein each sidewall defines a sidewall slot; and the locking members are engaged in the sidewall slots.

13. The printer of claim 12, further comprising a supporting plate secured to each sidewall of the bracket; the supporting plate defining a supporting plate opening; and each sliding member comprises a blocking piece engaged in the supporting plate opening.

14. The printer of claim 9, wherein a second spring member is secured to each sliding member; and the locking member has a first location and a second location where the second spring member has a resilient deformation greater than that in the first location.

15. The printer of claim 14, wherein the tray has tray blocks; and the locking members are disengaged from the tray blocks when the locking members are in the first location, and engaged with the tray blocks when the locking members are in the second location.

16. The printer of claim 9, further comprising a motor and a shaft attached to each sidewall; wherein the shafts being rotatable by the motors; and the sliding members are slidable when the shafts are rotated.

17. The printer of claim 9, wherein each retaining member comprises an inducting surface, and the retaining member is slidable by the tray post from a first location to a second location when the inducting surface is pressed by the tray post; and each retaining member has a retaining surface, and the tray post is slidable along the retaining surface when the tray post is released from the sliding member.

* * * * *